US010517365B2

(12) United States Patent
Ngo et al.

(10) Patent No.: US 10,517,365 B2
(45) Date of Patent: Dec. 31, 2019

(54) STEAM HAIRSTYLING DEVICE WITH IMPROVED CASING

(71) Applicant: SEB S.A., Ecully (FR)

(72) Inventors: Eddy Ngo, Lyons (FR); Martial Maisonneuve, Villefontaine (FR)

(73) Assignee: SEB S.A., Ecully (FR)

( * ) Notice: Subject to any disclaimer, the term of this patent is extended or adjusted under 35 U.S.C. 154(b) by 406 days.

(21) Appl. No.: 15/527,178

(22) PCT Filed: Nov. 16, 2015

(86) PCT No.: PCT/FR2015/053094
§ 371 (c)(1),
(2) Date: May 16, 2017

(87) PCT Pub. No.: WO2016/079409
PCT Pub. Date: May 26, 2016

(65) Prior Publication Data

US 2017/0340083 A1 Nov. 30, 2017

(30) Foreign Application Priority Data

Nov. 18, 2014 (FR) ..... 14 61153

(51) Int. Cl.
*A45D 6/06* (2006.01)
*A45D 1/06* (2006.01)
*A45D 1/00* (2006.01)
*A45D 2/00* (2006.01)

(52) U.S. Cl.
CPC ..... *A45D 1/06* (2013.01); *A45D 1/00* (2013.01); *A45D 2/001* (2013.01); *A45D 2001/008* (2013.01)

(58) Field of Classification Search
CPC ..... A45D 2001/008; A45D 1/02; A45D 1/00; A45D 1/08; A45D 1/06; A45D 20/52; A45D 2/001; A45D 2/002
USPC ..... 132/228, 271, 272
See application file for complete search history.

(56) References Cited

U.S. PATENT DOCUMENTS 8,915,779 B1 * 12/2014 Jardino ..... A45D 1/00 132/211
2012/0111355 A1 5/2012 Vacheron et al.
2012/0111356 A1 * 5/2012 Vacheron ..... A45D 1/04 132/228

* cited by examiner

*Primary Examiner* — Rachel R Steitz
(74) *Attorney, Agent, or Firm* — The Webb Law Firm

(57) ABSTRACT

Provided is a steam hairstyling device (1) comprising: two jaws (2, 3), including a first jaw (2) having a first longitudinal casing (21) that receives a first treatment surface (4), and a second jaw (3) having a second longitudinal casing (31) that receives a second treatment surface (5), said surfaces (4, 5) being intended to clamp a lock of hair. At least the first casing (21) comprises liquid vaporisation means (7) and steam distribution means (7'), said first casing (21) having an internal surface (22) facing the vaporisation means (7). The first casing (21) comprises, on its internal surface (22), a first series of projecting lines (220) and a second series of projecting lines (221) and at least a portion of the second series of projecting lines (221) intersects with at least a portion of the first series of projecting lines (220) so as to format least one air compartment (23).

13 Claims, 6 Drawing Sheets

STEAM HAIRSTYLING DEVICE WITH IMPROVED CASING

CROSS-REFERENCE TO RELATED APPLICATIONS

This application is the United States national phase of International Application No. PCT/FR2015/053094 filed Nov. 16, 2015, and claims priority to French Patent Application No. 1461153 filed Nov. 18, 2014, the disclosures of which are hereby incorporated in their entirety by reference.

Field of the Invention

The present invention pertains to the technical field of straightening iron hairstyling devices comprising at least one heated smoothing plate. More specifically, the invention pertains to the technical field of devices equipped with a vaporization system that makes it possible to apply steam to a lock of hair before, during or after straightening.

Description of Related Art

The first version of a device sold under the name "Steampod" and manufactured for the applicant comprises two arms mounted on a hinge, each arm comprising a heating plate positioned opposite one another. The device also comprises a base with a reservoir for a liquid in fluid communication with the portable device via a cord. The device comprises, in one of the two arms, means of vaporization and means of steam distribution.

Such a device presents the disadvantage of the overheating of the arms containing the means of vaporization and the means of steam distribution. This overheating is particularly noticeable in the treatment area of the casing, or in other words, the location of the vaporization chamber, which is heated to a temperature greater than 100° C. The heat in the vaporization chamber is transmitted via thermal conduction to user-accessible treatment area of the casing, which can cause burning sensations when this area comes into contact with the user's hands or scalp.

SUMMARY OF THE INVENTION

The objective of the invention is to address the aforementioned disadvantages and to propose a steam hairstyling device that reduces the risk of burns when the device comes into contact with the human body.

Another objective of the invention is to propose an anti-scald, steam hairstyling device that is easy and economical to manufacture.

These objects are achieved with a steam hairstyling device comprising:

- two jaws positioned opposite one another, the first of which comprises a first longitudinal casing that houses a first treatment surface, and a second jaw comprising a second longitudinal casing that houses a second treatment surface, the surfaces being designed to pinch a lock of hair,
- a liquid reservoir,
- at least the first casing comprising the means of vaporization of the liquid in fluid communication with the reservoir and the means of steam distribution in communication with the means of vaporization, said first casing having an internal surface with respect to the means of vaporization.

According to the invention, at least the first housing comprises on its internal surface a series of projecting lines running parallel to a first axis and a second series of projecting lines running parallel to a second axis, forming a non-zero angle with the first axis, and at least some of the second series of projecting lines intersect with at least some of the first series of projecting lines to form at least one air compartment.

The term treatment surface herein refers to any type of surface, whether flat, curved or corrugated, heated by a heating element. The treatment surface is contained within a treatment area of the casing, which is positioned on the side opposite the hinge that links the two jaws. Said internal surface is a part of the interior surface of the casing and is positioned within said treatment area.

The projecting lines on the casing make it possible to absorb a portion of the heat from the means of vaporization. Said compartments contain only air, which helps to reduce thermal conduction between the means of vaporization and the exterior of the casing. Testing demonstrated that the presence of air compartments resulted in a decrease in temperature of up to 30° C. in the treatment area.

Advantageously, the two axes are arranged with respect to one another at an angle between 80° and 100°, preferably 90°. Such a substantially orthogonal positioning makes it possible to create more uniform air compartments to improve heat distribution.

In addition, the projecting lines extend substantially over the entire interior surface of the first casing, which improves temperature homogeneity in the treatment area.

According to one characteristic of the invention, the median plane of the interior surface is approximately parallel to that of the first treatment surface to improve heat distribution and temperature homogeneity in the treatment area.

According to another characteristic of the invention, the height of the first series of projecting lines ranges from 1 mm to 9 mm, and is preferably 3 mm.

According to another characteristic of the invention, the height of the second series of projecting lines ranges from 1 mm to 8 mm, and is preferably 2 mm.

According to another characteristic of the invention, the length of each compartment with respect to the first axis ranges from 5 mm to 20 mm, and is preferably 14 mm.

According to yet another characteristic of the invention, the width of each compartment with respect to the second axis ranges from 3 mm to 15 mm, and is preferably 7 mm.

These dimensions make it possible to optimize the layout of the air compartments.

Advantageously, the projecting lines in each series have the same thickness.

In addition, the upper edge of one of the series of projecting lines exceeds that of the other series. The term upper edge refers to the edge oriented toward the treatment surface. This configuration makes it possible to create a lateral flow of air between the compartments.

According to the invention, the first jaw comprises in the first casing a means of thermal conduction in the form of a sheet positioned between the means of vaporization and the interior surface. According to tests, the sheet, for example a sheet of aluminum, helps to distribute heat and decrease the temperature of the casing.

Advantageously, said means of thermal conduction are supported by the upper edge of at least one of the two series of projecting lines. The means of conduction may be mounted to the projecting lines by means of an adhesive that is a simple and economical solution.

Finally, the series of projecting lines form a single piece with the first casing, and extend from the interior surface of the latter so as to be easily manufactured, for example, by molding.

BRIEF DESCRIPTION OF THE DRAWINGS

The invention will be better understood in reference to the embodiments provided as non-exhaustive examples and illustrated in the annexed figures, in which.

DETAILED DESCRIPTION OF THE INVENTION

Figure 1:
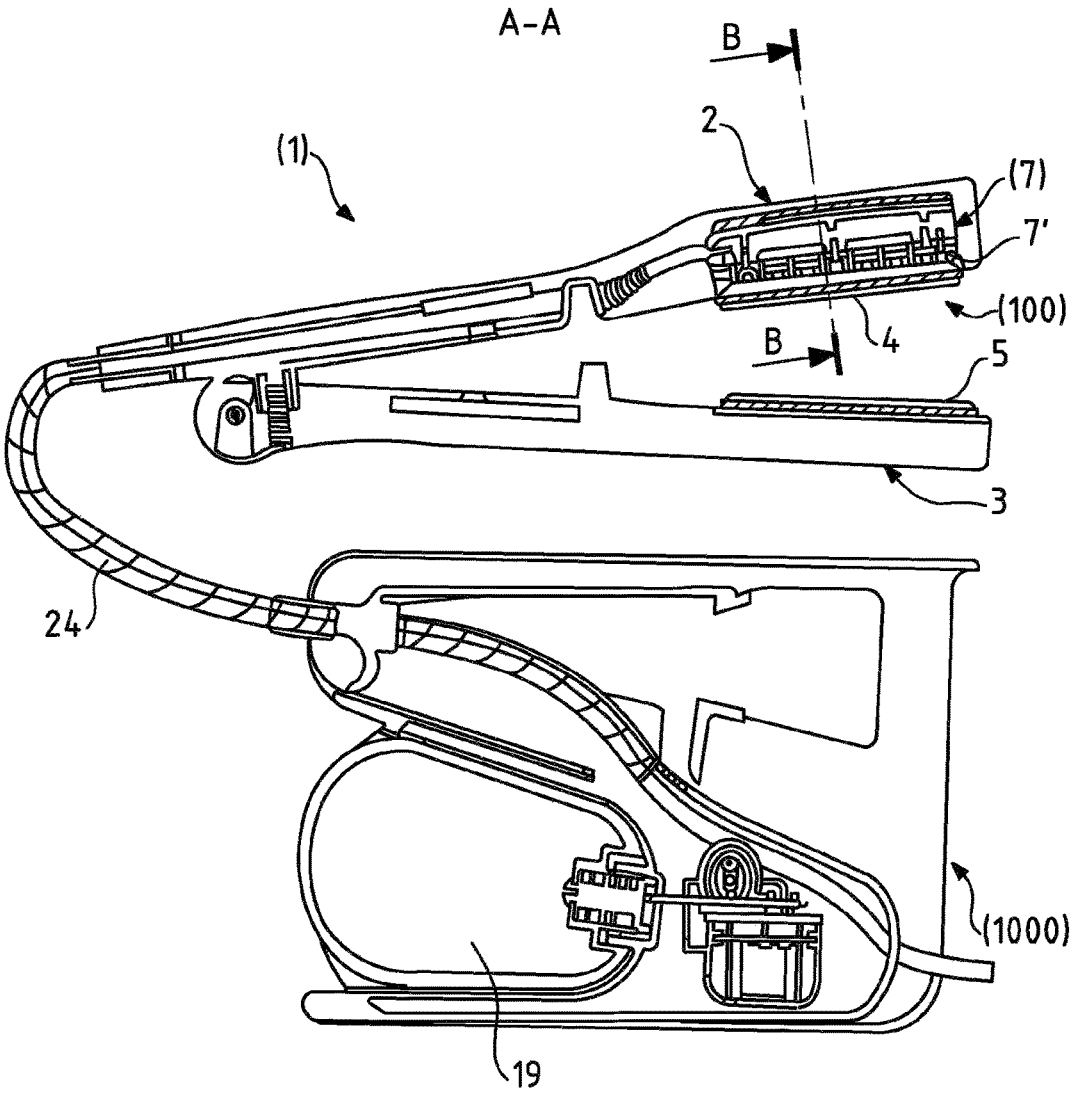
FIG. 1 is a cross-sectional view of an embodiment A of a hairstyling device according to the invention.
Figure 2:
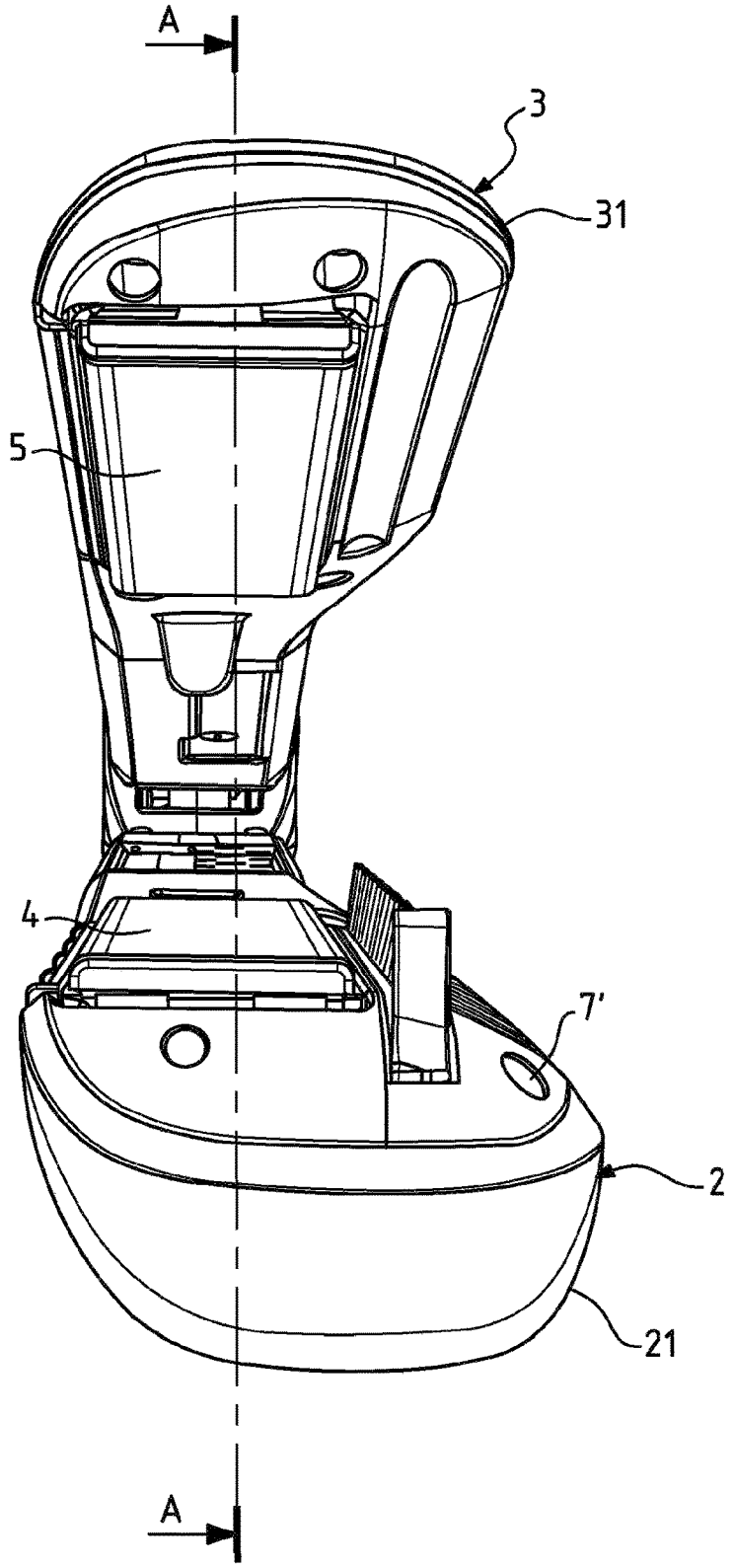
FIG. 2 is a front view of a mobile portion of the hairstyling device.

As depicted in FIGS. 1 and 2, the hairstyling device (1) is a straightening device and comprises two jaws (2, 3) that are connected with a hinge-type pivot point, the first jaw (2) having a first casing (21) of longitudinal form. The first casing (21) having a gripping area located near said pivot point and a treatment area housing a first treatment surface (4), which is a heating plate. The device also comprises a second jaw (3) having substantially the same form as the first jaw (2) and comprising a second longitudinal casing (31) with a gripping area and a treatment area housing a second treatment surface (5), which is a heating plate. The two jaws (2, 3) form a clamp, making it possible to have an angular space between these two jaws (2, 3) or for the two jaws (2, 3) to come into contact with one another, to pinch the hair placed between the two jaws (2, 3). In the example depicted, said heating plates each have a flat surface located on the interior surfaces of the jaws (2, 3). Thus, when pinched, the two flat heating surfaces are arranged opposite one another and concurrently make it possible to perform a heat treatment for hair, to carry out a straightening treatment. The treatment surfaces may take other forms, with respect to the type of treatment desired.

The device (1) furthermore comprises a vaporization system as illustrated in FIG. 1 comprising a base (1000) with a liquid reservoir (19). A mobile unit (100) comprises the two jaws (2, 3) as well as the means of vaporization (7) of the fluid, means of steam distribution (7') toward the hair and a cord (24) comprising at least one fluid conduit connecting the liquid reservoir (19) to the means of vaporization (7). The base (1000) is moved away from the mobile unit (100), and can be placed on a work surface. The configuration of such a device is described in patent document 2 967 017 as filed by the applicant and requires no further description.

Figure 3:
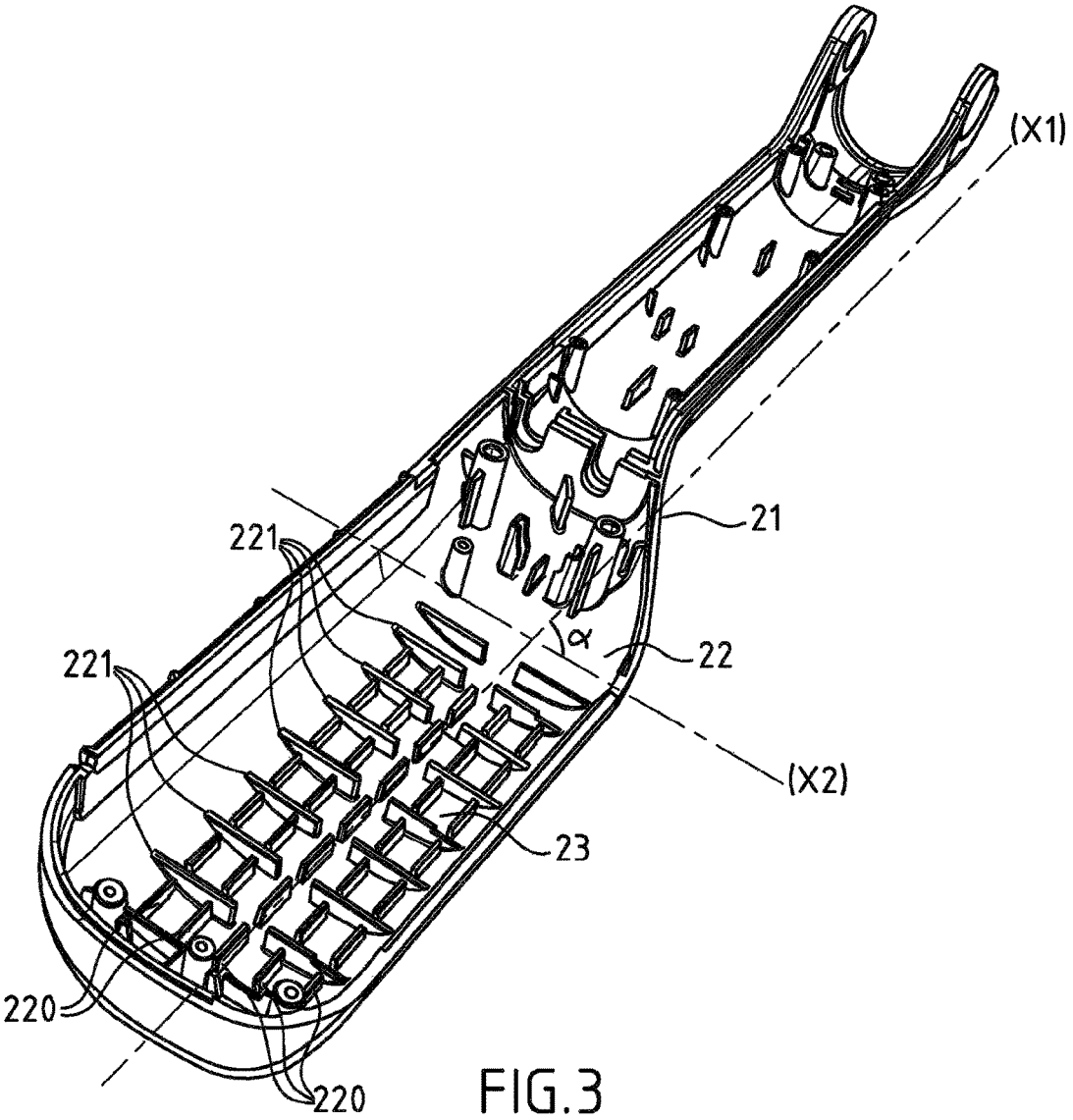
FIG. 3 is a perspective view of the casing of the first jaw of the device.
Figure 4:
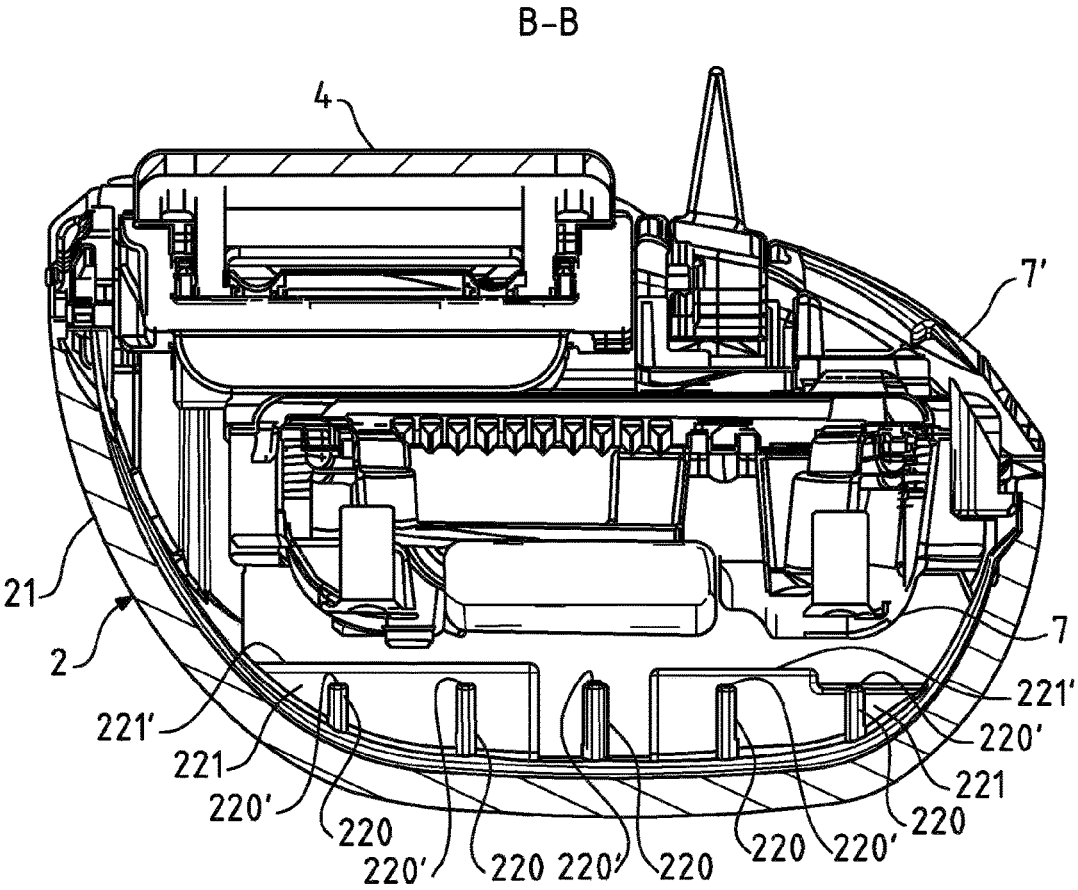
FIG. 4 is a cross-sectional view of an embodiment B of the first jaw of the device.

According to one example of the invention, said means of vaporization (7) of the fluid and said means of steam distribution (7') are located only in the first casing (21), hereafter, "the casing," depicted in detail in FIGS. 3 and 4. The casing (21) has an interior surface (22) approximately parallel to the first treatment surface (4) positioned at the base of the casing (21) and next to the means of vaporization (7). If the base of the casing is slightly curved, the median plane of the interior surface (22) is parallel to the first treatment surface (4). The interior surface (22) is separated from the means of vaporization (7) by a minimum distance creating space for projecting lines (220, 221) to include a first series of lines (220) running parallel to a first axis (X1) and a second series (221) running parallel to a second axis (X2), the two axes (X1, X2) forming a non-zero angle ($\alpha$). As depicted in FIG. 3, the first axis (X1) is approximately parallel to the axis of symmetry for the casing (21) and the angle (a) ranges from 80° to 100° and is preferably 90° so that the two series of lines (220, 221) are orthogonal with respect to each other.

As depicted in FIG. 3, at least one portion of the second series of projecting lines (221) intersects with at least one portion of the first series of projecting lines (220) to form at least one air compartment (23). To do so, the projecting lines (220, 221) extend from the interior surface (22) to a height ranging from 1 mm to 9 mm for the first series of projecting lines (220), and from 1 mm to 8 mm for the second series of projecting lines (221). In the depicted example, the series of projecting lines (220, 221) form two rows of compartments to each side of the center of the casing, oriented in the same direction as the first axis (X1). The length of each compartment as defined by the first axis X1 ranges from 5 mm to 20 mm and the width of each compartment as defined by the second axis X2 ranges from 3 mm to 15 mm. To facilitate low-cost manufacturing, the series of projecting lines form a single piece with the first casing. Preferably, the projecting lines of each series have the same thickness to further facilitate manufacturing, for example, by molding.

Figure 5:
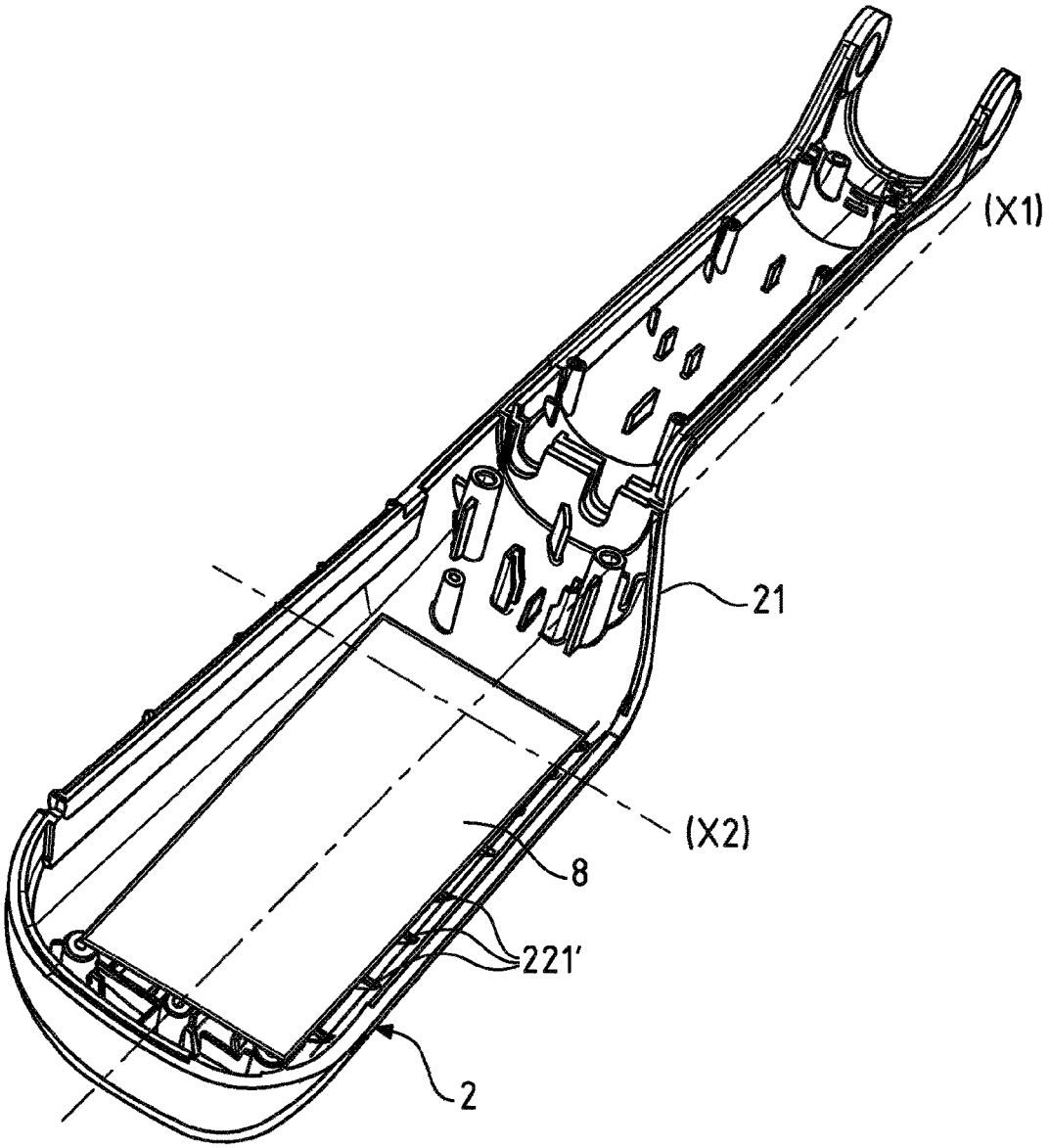
FIG. 5 is a perspective view of the casing of the first jaw of the device according to one variation.

According to one characteristic of the invention, the upper edge (221') of the second series of projecting lines (221) extends beyond the upper edge (220') of the first series of projecting lines (220), as depicted in FIG. 4. The term upper edge refers to the edge oriented toward the first treatment surface (4). This configuration promotes the lateral flow between the compartments, particularly when the former are covered with a means of thermal conduction (8) as depicted in FIG. 5. Said means of thermal conduction (8) may be a sheet of aluminum. It is arranged between the means of vaporization (7) and the interior surface (22) and is supported by the upper edge (221') of the second series of projecting lines (221).

Figure 6:
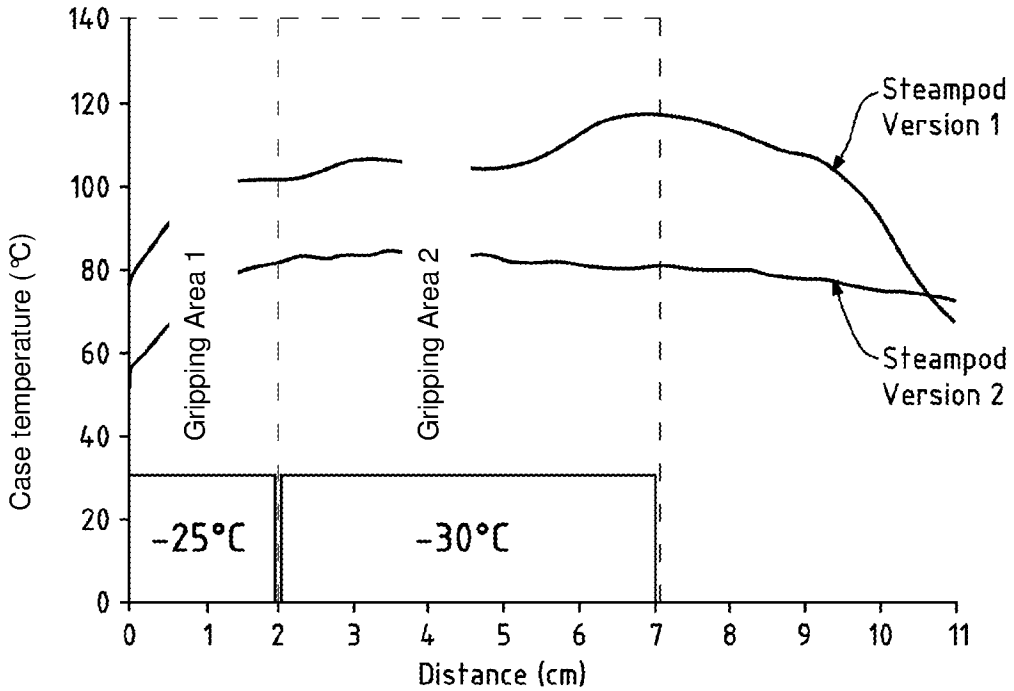
FIG. 6 is a table showing a comparison of the average temperatures of two devices.

The use of projecting lines on the interior surface of the casing has been shown to significantly aid in the distribution of heat from the means of vaporization and in eliminating the hot area on the exterior of the casing. Such projecting lines are used in a second version of the "Steampod" device, called the "Steampod Version 2." FIG. 6 shows a graph of the average temperatures measured on the first casing, compared between two devices called "Steampod Version 1" and "Steampod Version 2." The X-axis represents the distance from the extremity opposite the hinge (0 to 2 cm for the 1st area and 2 to 7 cm for the 2nd area) and the Y-axis represents the average temperature measured. The graph shows that the average temperature of "Steampod Version 2," is 25° C. lower in the 1st area and 30° C. lower in the 2nd area compared to "Steampod Version 1," which represents a significant difference in the user-friendliness of a hairstyling device.

Other modifications may be made to the invention within the framework of the annexed claims.

The invention claimed is:

1. Steam hair styling device comprising:

two jaws positioned opposite each other, the first jaw comprising a first longitudinal casing housing a first treatment surface, the second jaw comprising a second longitudinal casing housing a second treatment surface, the surfaces being designed to pinch a lock of hair, a liquid reservoir, at least the first casing comprising means of vaporization for the liquid in fluid communication with the reservoir and means of steam distribution in communication with the means of vaporization, said first casing having an interior surface facing the means of vaporization, wherein at least the first casing comprises on an interior surface a first series of projecting lines running parallel to a first axis (X1) and a second series of projecting lines parallel to a second axis (X2) forming a non-zero angle ($\alpha$) with the first axis (X1), and wherein at least a portion of the second series of projecting lines intersects with at least a portion of the first series of projecting lines to form at least one air compartment.

2. Device according to claim 1, wherein the two axes (X1, X2) are positioned with respect to each other at an angle ($\alpha$) ranging from 80 degrees to 100 degrees.

3. Device according to claim 1, wherein the projecting lines extend substantially over an entire interior surface of the first casing.

4. Device according to claim 1, wherein a median plane of the interior surface is substantially parallel to a plane of the first treatment surface.

5. Device according to claim 1, wherein a height of the first series of projecting lines ranges from 1 mm to 9 mm.

6. Device according to claim 5, wherein a height of the second series of projecting lines ranges from 1 mm to 8 mm.

7. Device according to claim 1, wherein a length of each air compartment as defined by the first axis (X1) ranges from 5 mm to 20 mm.

8. Device according to claim 7, wherein a width of each air compartment as defined by the second axis (X2) ranges from 3 mm to 15 mm.

9. Device according to claim 1, wherein the projecting lines of each series have the same thickness.

10. Device according to claim 1, wherein an upper edge of one of the series of projecting lines extends beyond that of the other series.

11. Device according to claim 1, wherein the first jaw comprises in the first casing a means of thermal conduction in the form of a sheet positioned between the means of vaporization and the interior surface.

12. Device according to claim 11 wherein the means of thermal conduction are supported by an upper edge of at least one of the two series of projecting lines.

13. Device according to claim 1, wherein the first and second series of projecting lines form a single piece with the first casing and extend from the interior surface of the first casing.

* * * * *